US007785444B2

(12) United States Patent
Berenstain

(10) Patent No.: US 7,785,444 B2
(45) Date of Patent: Aug. 31, 2010

(54) CYLINDRICAL SUCTION BOX ASSEMBLY

(75) Inventor: Yuval Berenstain, Yokneam (IL)

(73) Assignee: N.R. Spuntech Industries Ltd, Upper Tiberias (IL)

( * ) Notice: Subject to any disclaimer, the term of this patent is extended or adjusted under 35 U.S.C. 154(b) by 498 days.

(21) Appl. No.: 11/846,531

(22) Filed: Aug. 29, 2007

(65) Prior Publication Data

US 2008/0053635 A1 Mar. 6, 2008

(30) Foreign Application Priority Data

Aug. 30, 2006 (IL) ..... 177788

(51) Int. Cl.
*D21F 1/48* (2006.01)

(52) U.S. Cl. ..... 162/217; 162/362; 277/407; 442/408; 28/104

(58) Field of Classification Search ..... 162/362, 162/374, 371, 217; 277/407, 944, 946; 28/104; 442/408, 415
See application file for complete search history.

(56) References Cited

U.S. PATENT DOCUMENTS 5,301,401 A * 4/1994 Suzuki et al. ..... 28/167
5,414,914 A * 5/1995 Suzuki et al. ..... 28/105
5,718,022 A * 2/1998 Vuillaume ..... 28/105
5,761,778 A * 6/1998 Fleissner ..... 28/104
5,768,756 A * 6/1998 Noelle ..... 28/104
5,876,566 A * 3/1999 Frawley, Jr. ..... 162/374
6,055,710 A * 5/2000 Fleissner ..... 28/104
6,241,854 B1 * 6/2001 Frawley, Jr. ..... 162/371
6,270,623 B1 * 8/2001 Goda et al. ..... 162/114
6,324,738 B1 * 12/2001 Fleissner ..... 28/104
6,695,941 B2 * 2/2004 Hartgrove et al. ..... 156/148
6,796,010 B2 * 9/2004 Noelle ..... 28/104
2002/0160681 A1 * 10/2002 Noelle ..... 442/408

* cited by examiner

*Primary Examiner*—Mark Halpern
(74) *Attorney, Agent, or Firm*—Roach Brown McCarthy & Gruber, P.C.; Kevin D. McCarthy

(57) ABSTRACT

The present invention provides a cylindrical suction box assembly with a suction box having two or more suction chambers that operate at different suction pressures. A lower suction pressure suction chamber is configured to provide lower suction pressure suction and is used in conjunction with the texturing process. At least one higher suction pressure suction chamber is configured to provide higher suction pressure suction and is used in conjunction with the de-watering process of the present invention. Therefore, according to the present invention two processes that are traditionally performed on two different devices are performed on a single cylindrical suction box assembly.

12 Claims, 7 Drawing Sheets

Prior Art

CYLINDRICAL SUCTION BOX ASSEMBLY

FIELD AND BACKGROUND OF THE INVENTION

The present invention relates to cylindrical suction boxes and, in particular, it concerns a cylindrical suction box assembly having two or more suction chambers that operate at different suction pressures.

It is known to provide a patterning cylinder having a substantially hollow interior volume and to generate a vacuum state within the interior volume. The suction force created by the vacuum state serves to draw the fluid, generally water, used in the texturing process out of the cylinder. This process leaves the fabric with a relatively high water content requiring de-watering using a de-watering box further along the production line.

Since the now textured fabric is no longer being supported by the patterning cylinder, the air being drawn through the fabric by the suction force of the suction box will follow a path of least resistance such as through the regions where the fabric is thinnest. Therefore, the thicker areas of the fabric, where the resistance to air flow is higher, will retain more water and will require longer drying, thereby increasing production costs.

There is therefore a need for cylindrical suction box assembly having two or more suction chambers that operate at different suction pressures such that the water introduced to the interior of the suction box during the texturing process is drawn out by a low suction force and the fabric is then de-watered by a high suction force while still supported by the patterning cylinder.

SUMMARY OF THE INVENTION

The present invention is a cylindrical suction box assembly having two or more suction chambers that operate at different suction pressures.

According to the teachings of the present invention there is provided, a cylindrical suction box assembly for applying an embossed pattern to at least a portion of a continuous sheet of non-woven fabric produced by a water-entanglement process, the cylindrical suction box assembly comprising: a) a cylindrical suction box having a substantially cylindrical outer wall with a plurality of longitudinal slots configured in the outer wall, the suction box being substantially hollow with at least one interior dividing partition configured to divide an interior volume of the suction box into at least first and second suction chambers such that at least a first of the plurality of longitudinal slots opens into the first suction chamber and at least a second of the plurality of longitudinal slots opens into the second suction chamber; b) at least one fluid injector deployed proximal to an outer surface of the suction box and aligned with at least a first one of the plurality of longitudinal slots, the at least one fluid injector configured to deliver a flow of fluid to a surface of the substantially continuous sheet of non-woven fabric, the fluid then passing through the first of the plurality of longitudinal slots into the first suction chamber; and c) an embossing roller having a patterned outer surface having a plurality of embossing-indentations, the embossing roller deployed about the suction box such that during rotation at least a portion of the embossing roller: i) passes between the fluid injector and the first of the plurality of longitudinal slots so as to force a portion of the non-woven fabric into at least some of the plurality of embossing-indentations; and ii) subsequently passes over the second of the plurality of longitudinal slots such that a de-watering process is performed while the portion of the non-woven fabric remains in the plurality of embossing-indentations, and at least a portion of water being carried by the non-woven fabric is drawn into the second suction chamber.

According to a further teaching of the present invention, there is also provided a suction system having at least one suction device, the suction system configured to generate suction pressure within the first and the second suction chambers such that a suction pressure in the first suction chamber differs from a suction pressure generated in the second suction chamber.

According to a further teaching of the present invention, the fluid injector is configured as a plurality of fluid injectors, and each of the plurality of fluid injectors is aligned with a different one of the plurality of longitudinal slots each of which opens into the first suction chamber.

According to a further teaching of the present invention, the second suction chamber is configured as first and second de-watering chambers and the second of the plurality of longitudinal slots is configured as first and second de-watering slots such that the first de-watering chamber performs the de-watering process during the rotation in a first direction and the second de-watering chamber performs the de-watering process during the rotation in a second direction.

There is also provided according to the teachings of the present invention, a cylindrical suction box assembly for applying an embossed pattern to at least a portion of a continuous sheet of non-woven fabric produced by a water-entanglement process, the cylindrical suction box assembly comprising: a) substantially cylindrical suction box having at least one lower suction pressure suction chamber and at least one higher suction pressure suction chamber, the suction box configured with at least one longitudinal texturing slot opening into the lower suction pressure suction chamber and at least one longitudinal de-watering slot opening into the higher suction pressure suction chamber; b) at least one fluid injector deployed proximal to an outer surface of the suction box and aligned with the texturing slot, the fluid injector configured to deliver a flow of fluid to a surface of the substantially continuous sheet of non-woven fabric, the fluid then passing through the texturing slot into the lower suction pressure suction chamber; and c) an embossing roller having a patterned outer surface with a plurality of embossing-indentations, the embossing roller deployed about the suction box such that during rotation at least a portion of the embossing roller: i) passes between the fluid injector and the texturing slot such that a portion of the non-woven fabric is forced into at least some of the plurality of embossing-indentations; and ii) subsequently passes over the de-watering slot such that a de-watering process is performed while the portion of the non-woven fabric remains in the plurality of embossing-indentations, and at least a portion of water being carried by the non-woven fabric is drawn into the second suction chamber.

According to a further teaching of the present invention, there is also provided a suction system having at least one suction device, the suction system configured to generate suction pressure within the lower and the higher suction chambers such that a suction pressure in the lower suction chamber is lower than a suction pressure generated in the higher suction chamber.

According to a further teaching of the present invention, the at least one fluid injector is configured as a plurality of fluid injectors and the at least one texturing slot is configured as a plurality of texturing slots, and each of the plurality of fluid injectors is aligned with a different one of the plurality of texturing slots each of which opens into the lower suction pressure suction chamber.

According to a further teaching of the present invention, the at least one higher suction pressure suction chamber is configured as first and second higher suction pressure suction chambers and the at least one de-watering slot is configured as first and second de-watering slots such that the first de-watering chamber performs the de-watering process during the rotation in a first direction and the second de-watering chamber performs the de-watering process during the rotation in a second direction.

There is also provided according to the teachings of the present invention, a method for applying a texture to a surface of a substantially continuous sheet of fabric and performing a de-watering process on the patterned fabric using a single cylindrical suction box, the method comprising: a) providing a substantially cylindrical suction box having at least one lower suction pressure suction chamber and at least one higher suction pressure suction chamber, the suction box configured with at least one longitudinal texturing slot opening into the lower suction pressure suction chamber and at least one longitudinal de-watering slot opening into the higher suction pressure suction chamber; b) providing at least one fluid injector deployed proximal to an outer surface of the suction box and aligned with the texturing slot, the at least one fluid injector configured to deliver a flow of fluid to a surface of the substantially continuous sheet of non-woven fabric, the fluid then passing through the texturing slot into the lower suction pressure suction chamber; c) providing an embossing roller having a patterned outer surface having a plurality of embossing-indentations, the embossing roller deployed about the suction box; d) rotating the embossing roller such that at least a portion of the embossing roller passes between the fluid injector and the texturing slot such that a portion of the non-woven fabric is forced into at least some of the plurality of embossing-indentations; and e) continuing rotation of the embossing roller such that the portion of the embossing roller subsequently passes over the de-watering slot such that a de-watering process is performed while the portion of the non-woven fabric remains in the plurality of embossing-indentations, and at least a portion of water being carried by the non-woven fabric is drawn into the second suction chamber.

According to a further teaching of the present invention, there is also provided a suction system having at least one suction device, the suction system configured to generate suction pressure within the lower and the higher suction chambers such that a suction pressure in the lower suction chamber is lower than a suction pressure generated in the higher suction chamber.

According to a further teaching of the present invention, the at least one fluid injector is implemented as a plurality of fluid injectors and the at least one texturing slot is implemented as a plurality of texturing slots, and each of the plurality of fluid injectors is aligned with a different one of the plurality of texturing slots each of which opens into the lower suction pressure suction chamber.

According to a further teaching of the present invention, the at least one higher suction pressure suction chamber is implemented as first and second higher suction pressure suction chambers and the at least one de-watering slot is implemented as first and second de-watering slots such that the first de-watering chamber performs the de-watering process during the rotation in a first direction and the second de-watering chamber performs the de-watering process during the rotation in a second direction.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
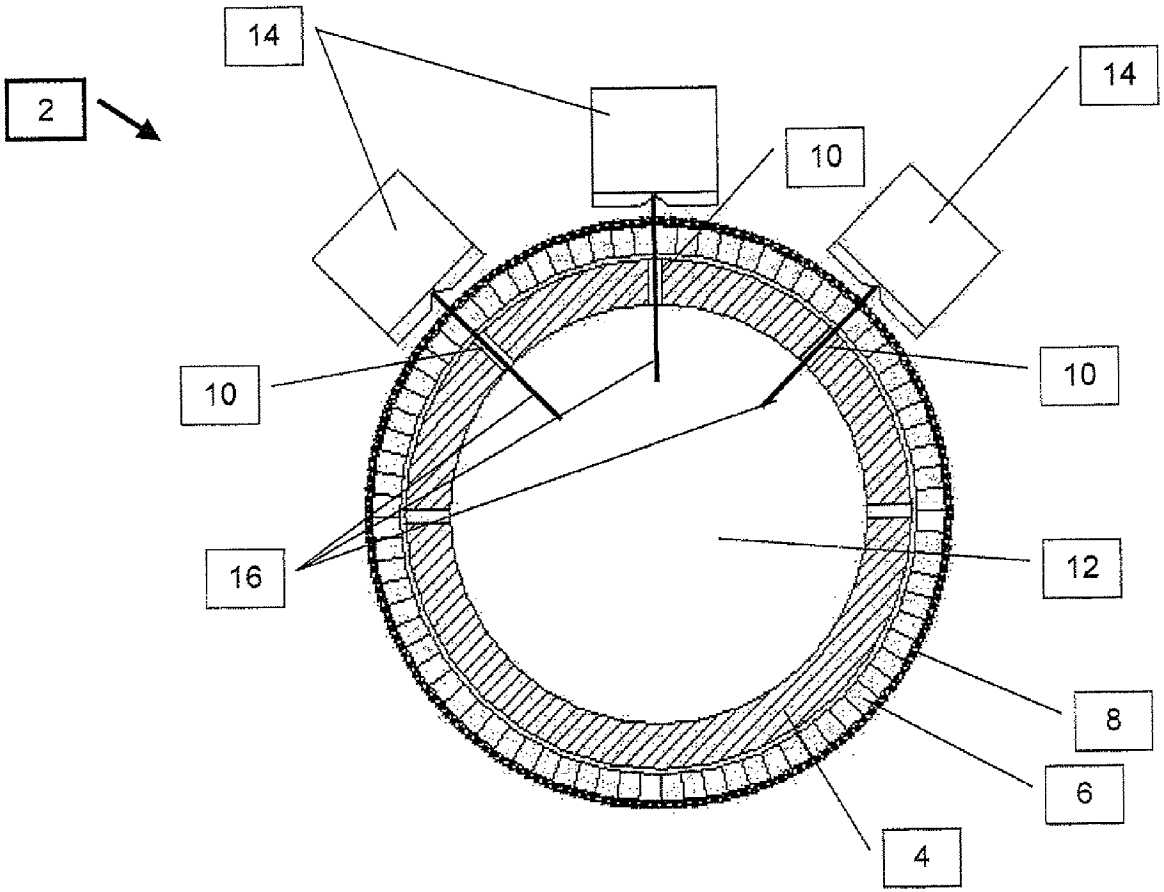
Prior Art FIG. 1
FIG. 1 is a cross section of a typical patterning cylinder assembly of the prior art.

The present invention is a cylindrical suction box having two or more suction chambers that operate at different suction pressures.

The principles and operation of cylindrical suction box assembly according to the present invention may be better understood with reference to the drawings and the accompanying description.

By way of introduction, the present invention provides a cylindrical suction box assembly for applying an embossed pattern to at least a portion of a continuous sheet of non-woven fabric. Preferably, the non-woven fabric is produced by a water-entanglement process. The suction box unit of the assembly has two or more suction chambers that operate at different vacuum pressures.

A first suction chamber is configured to provide lower vacuum pressure suction and is used in conjunction with the patterning or texturing process of the present invention. It should be noted that the terms “patterning” and “texturing” may be used interchangeably herein. The texture may be embossed or apertured in nature. Although, this general process is known in the art, it is usually performed on a single dedicated patterning cylinder assembly.

At least a second suction chamber is configured to provide higher vacuum pressure suction and is used in conjunction with the de-watering process of the present invention. Here also, the general de-watering process is known in the art, however, it is usually performed by a dedicated de-watering device.

Therefore, according to the present invention two processes that are traditionally performed on two different devices are performed on the single cylindrical suction box assembly of the present invention. This has a number of added benefits over the current state of the art. One benefit is that the de-watering process enhances the quality of the embossing.

The current state of the art de-watering systems have a tendency to flatten or otherwise lessen the quality of the embossing.

Another benefit relates to the drying and overall handling of the fabric after the embossing process. The system of the present invention removes more water from the fabric while it is still on the same machine that added the water during the embossing process, therefore, there is less overall water weight added to the fabric as it is move along the production line, which provides a savings in energy needed to move the fabric, and less strain and wear on the machinery in the production line.

Another benefit relating to the lower water content of the fabric occurs due to the uniform distribution of the water content in the fabric after de-watering. As will be discussed below, the prior art de-watering systems tend to have an uneven distribution of the water content, with a higher water level in the thicker embossed regions and a lower level of water in the thinner non-embossed regions. Such uneven distribution results in the use of drying energy necessary to fully dry the thicker embossed regions. The system of the present invention, by providing fabric with substantially uniform water distribution, reduces the amount of energy necessary to dry the fabric. It should be noted that as used herein the terms "high pressure" and "higher pressure" refer to a vacuum pressure higher than 2,000 mm $H_2O$, and preferably about 4,500 mm $H_2O$. The terms "low pressure" and "lower pressure" as used herein refer to a vacuum pressure lower than 2,000 mm $H_2O$, and preferably about 1,300 mm $H_2O$. Further, the terms "suction pressure" and "vacuum pressure" are used interchangeably herein.

Figure 2:
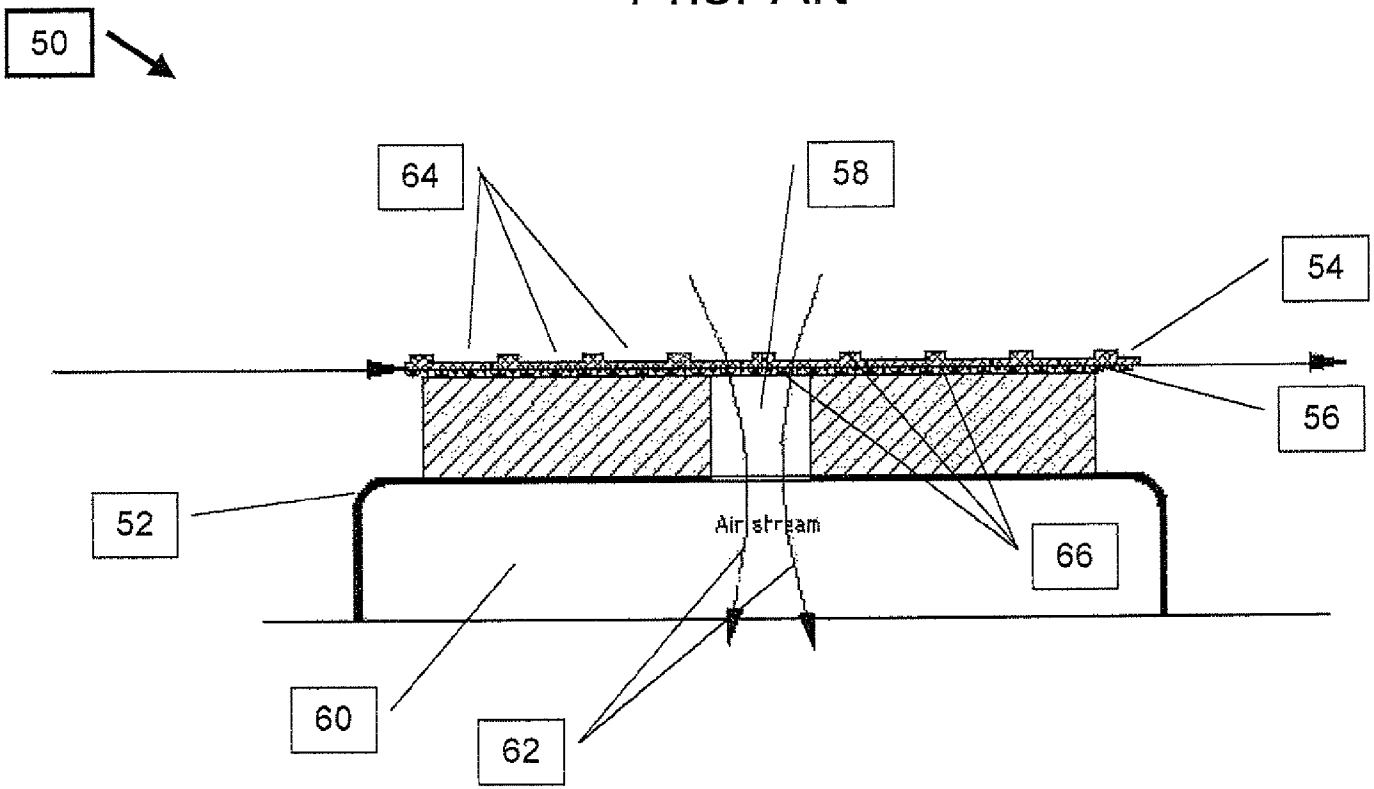
FIG. 2 is a cross section of a typical de-watering suction box deployed along the conveyor belt as is known in the prior art.

Referring now to the drawings, FIGS. 1 and 2 illustrate a patterning cylinder assembly 2 and separate suction box assembly 50, respectively, as are currently known in the art. Currently, a patterning cylinder assembly 2 includes a static substantially cylindrical suction box 4 upon which is deployed a rotating support cylinder 6. The rotating support cylinder 6 is porous, generally of a honeycomb configuration, and carries a patterning cylinder 8 that may be changed dependent on the desired pattern or texture to be applied to the fabric (not shown).

Configured in the static suction box 4 are at least one, and preferably a plurality, of longitudinal slots 10 that provide openings to the interior volume 12 of the suction box 4. Deployed proximal to the outer surface of the suction box 6 is at least one fluid injector 14, and preferably, a plurality of fluid injectors 14 each of which is aligned with a different one of the plurality of longitudinal slots 10. As the rotating support cylinder 6 rotates about the suction box 4 carrying the patterning cylinder 8 and the fabric, fluid 16, preferably water, is discharged from each of the injectors 14, thereby forcing the fabric against the patterning cylinder 8 so as to impart the desired pattern. The water that passes through the fabric continues through the patterning cylinder 8, the rotating support cylinder 6 and the corresponding longitudinal slot 10 into the interior volume 12 of the suction box 4. Generally, the interior volume 12 has a vacuum pressure lower than 2000 mm $H_2O$ to facilitate extraction of the water entering the interior volume 12 of the suction box 4.

Since the water content of the fabric is still quite high, a de-watering device, generally a de-watering suction box assembly 50, is deployed further along the production line. A typical de-watering suction box assembly 50 includes a suction box 52 having at least one vacuum slot 58 that allows air to be drawn through the fabric 54 that is supported by the conveyor belt 56 as it moves along the production line. The movement of the air through the fabric draws at least a portion of the remaining water out of the fabric. The vacuum pressure in the de-watering suction box is high, generally higher than 2,000 mm $H_2O$. One problem with this manner of de-watering is that as the air is drawn through the fabric and the vacuum slot 58 into the interior volume 60 of the suction box 52, the air will travel the "path of least resistance" 62 passing through, and drawing water from, the thinnest regions 64 of the fabric while flowing around the thicker regions 66 of the fabric, thereby, leaving the thicker regions 66 with a water content that is higher than the surrounding thin regions 64. The time and energy required to dry the thicker regions 66 adds to the overall cost of production of such textured fabric.

Figure 3:
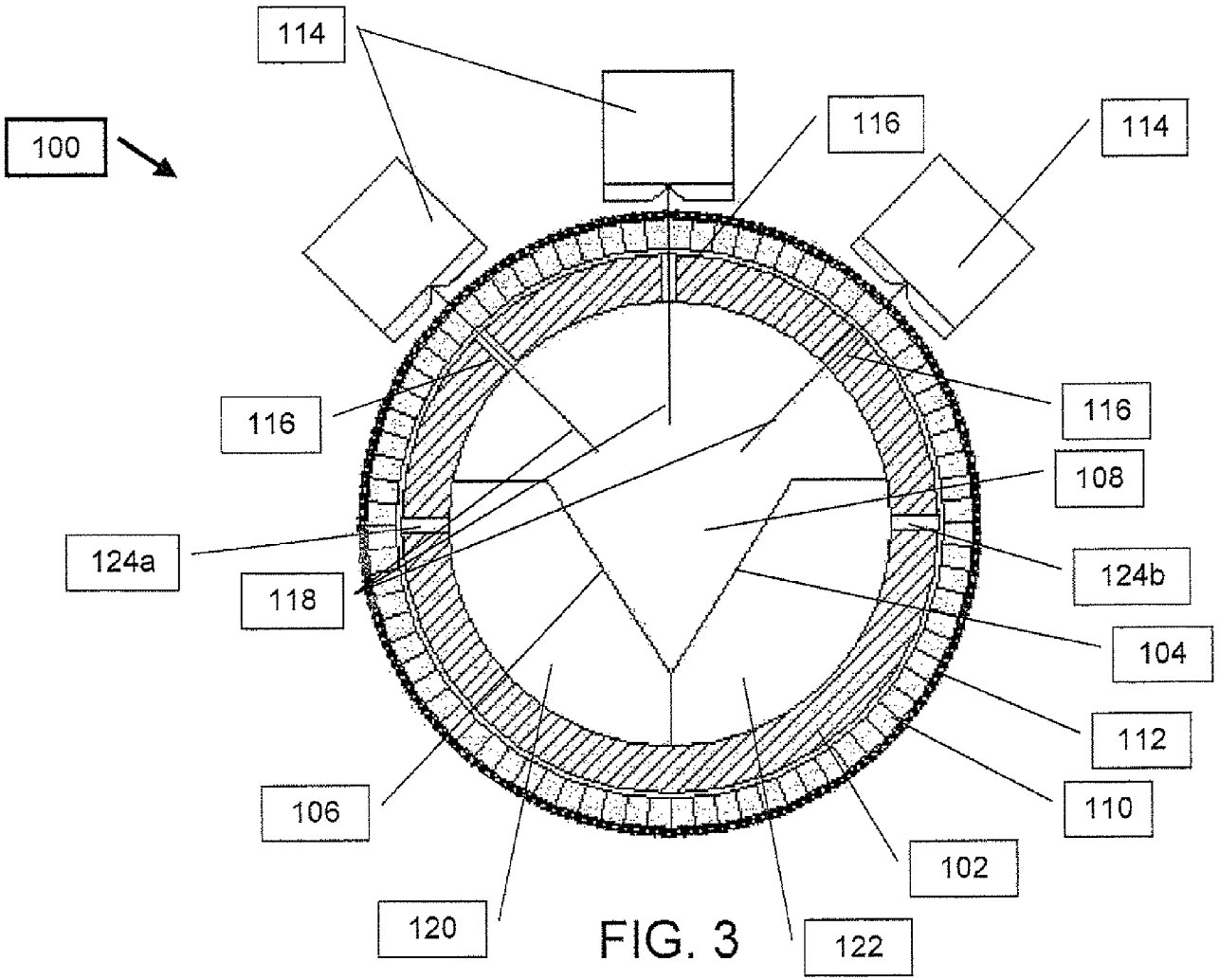
FIG. 3 is a cross section of a preferred embodiment of a cylindrical suction box assembly constructed and operative according to the teachings of the present invention.

FIG. 3 illustrates a preferred embodiment of a cylindrical suction box assembly 100 according to the teaching of the present invention. The interior volume substantially cylindrical suction box 102 is divided into three suction chambers by partitions 104 and 106. Deployed on the outer surface of suction box 102 are a rotating support cylinder 110 and an embossing roller 112 substantially as those described above.

The low vacuum pressure suction chamber 108 functions substantially in the same manner as the suction box of prior art described with regard to FIG. 1. Included in this portion of the cylindrical suction box assembly 100 of the present invention are the fluid injectors 114 and the corresponding texturing slots 116. As the rotating support cylinder 110 rotates about the suction box 102 carrying the fabric (not shown), fluid 118, preferably water, is discharged from each of the injectors 114, thereby forcing the fabric against the embossing roller 112 so as to impart the desired pattern. The water that passes through the fabric continues through the corresponding texturing slot 116 into the interior volume 108 of the low vacuum pressure suction chamber 108. Generally, the low vacuum pressure suction chamber 108 has a vacuum pressure of less than 2,000 mm $H_2O$, and preferably a vacuum pressure of 1300 mm $H_2O$, to facilitate extraction of the water entering the low vacuum pressure suction chamber 108.

Each of the higher vacuum pressure suction chambers 120 and 122 are configured with at least one de-watering slot 124*a* and 124*b*, respectively, and function in a manner similar to the de-watering suction box described above with regard to FIG. 2. The vacuum pressure in the higher vacuum pressure suction chambers 120 and 122 is preferably 4,500 mm $H_2O$.

Figure 4:
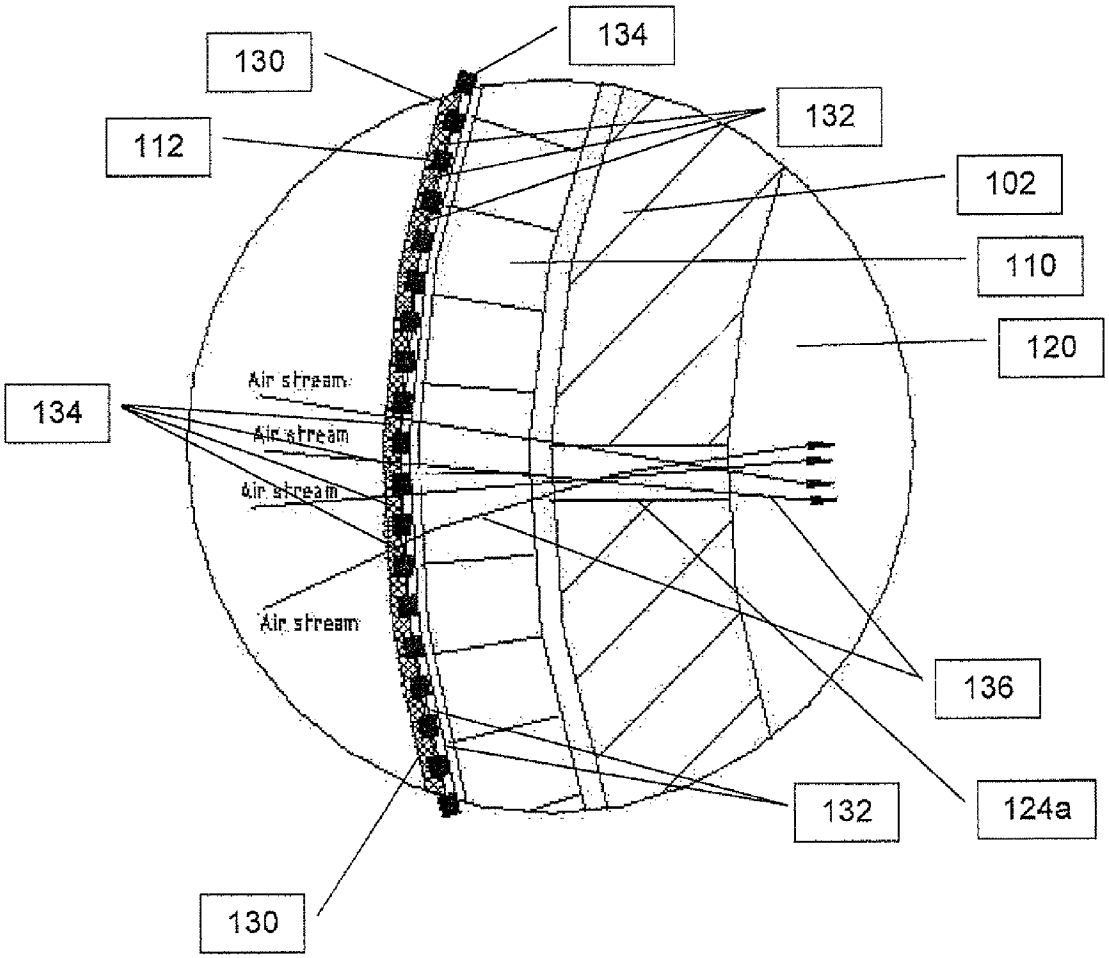
FIG. 4 is a detail of a high vacuum pressure slot of the embodiment of FIG. 3.

As illustrated in the detail of FIG. 4, as the rotating support cylinder 110 rotates about the suction box 102 it carries the embossing roller 112 and a portion of the fabric 130 over de-watering slot 124*a*. As the embossing roller 112 and the portion of the fabric 130 pass over de-watering slot 124*a*, air is drawn through the fabric 130 and embossing-indentations 132 configured in the embossing roller 112 as through bores. The embossing-indentations 132 generally correspond to the raised or thicker regions 134 of the fabric 130. Therefore, the flow of air of the present invention (illustrated by arrows 136) into the high vacuum pressure suction chamber 120 draws the water from the thicker regions 134 of the fabric 130. This is opposed to the suction boxes of prior art which tend to draw water from the thinnest regions of the fabric, as discussed above.

Figure 5:
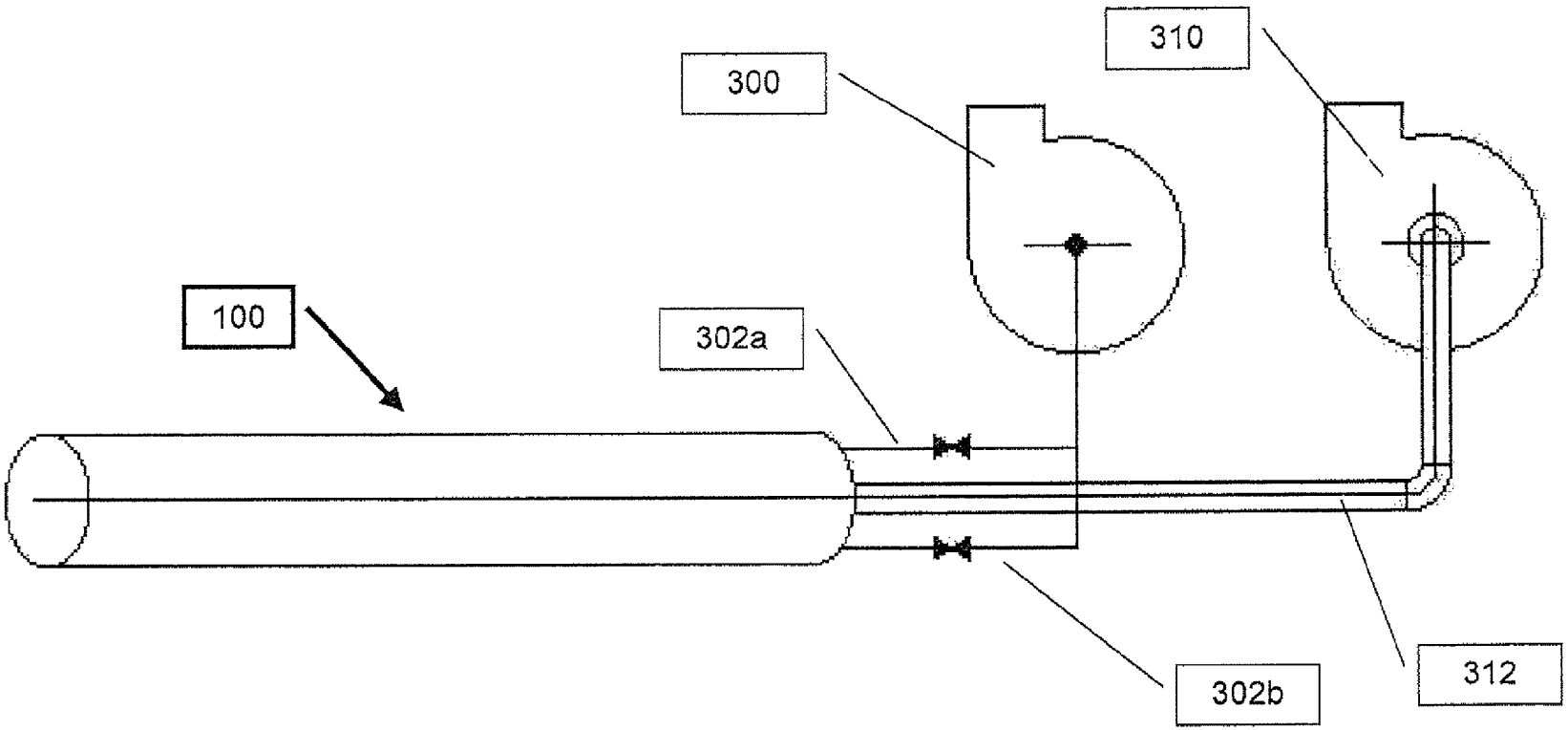
FIG. 5 is a schematic drawing of the vacuum blower connections according to the teaching of the present invention.

FIG. 5 schematically illustrates a possible vacuum blower connection arrangement forming a suction system. As illustrated here, a single high vacuum blower 300 is in switchable fluid communication with both high vacuum pressure suction chambers configured in suction box 100 by way of closeable conduits 302*a* and 302*b*. A single low vacuum blower 310 is in fluid communication with the low vacuum pressure suction chamber configured in suction box 100 by way of conduit 312. It will be appreciated that substantially any vacuum blower arrangement is within the scope of the present invention. For example, each suction chamber may have one or more dedicated vacuum blowers.

Figure 6:
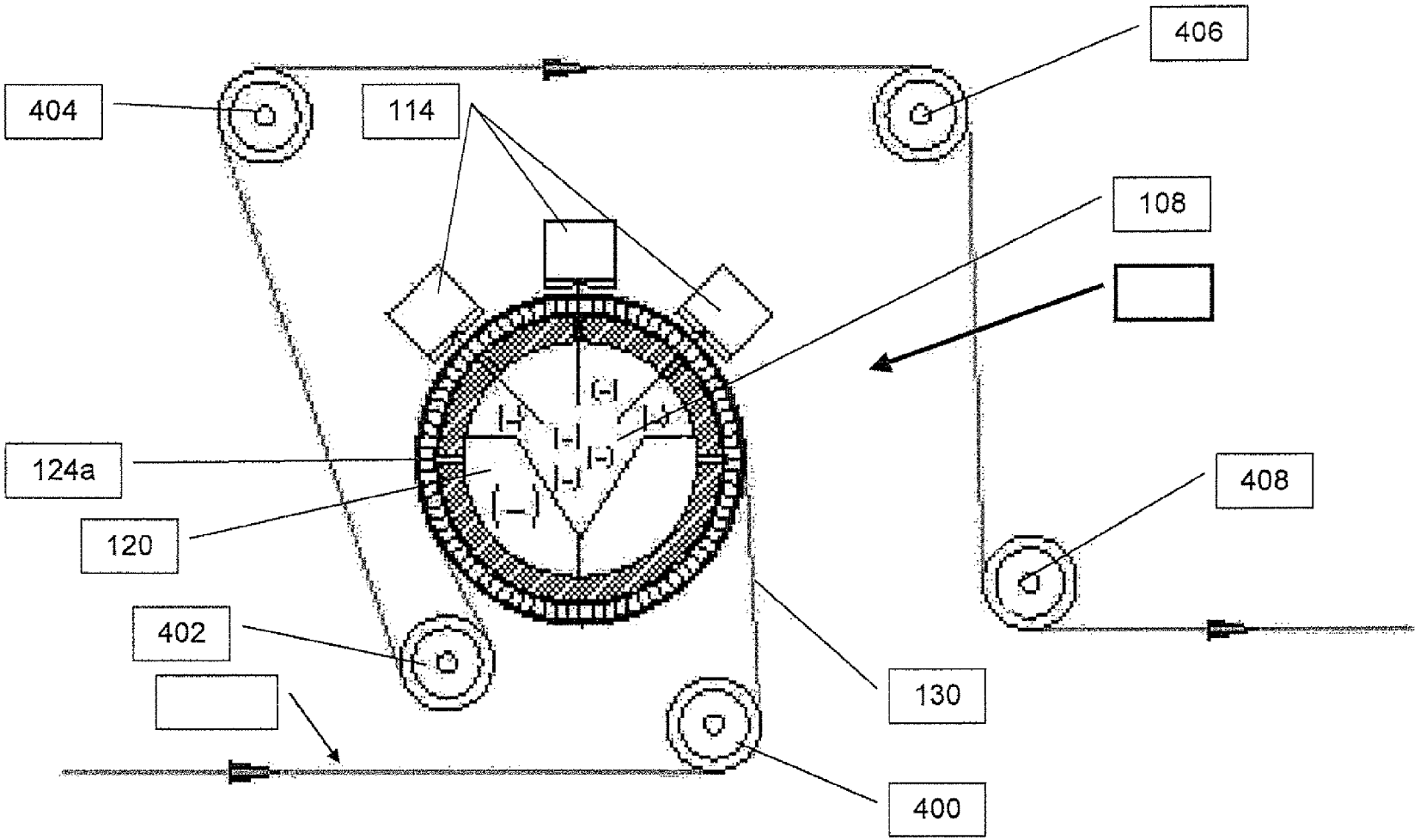
FIG. 6 is a schematic cross section of a patterning system constructed and operative according to the teachings of the present invention, shown here configured to apply the textured pattern to a first side of the fabric.
Figure 7:
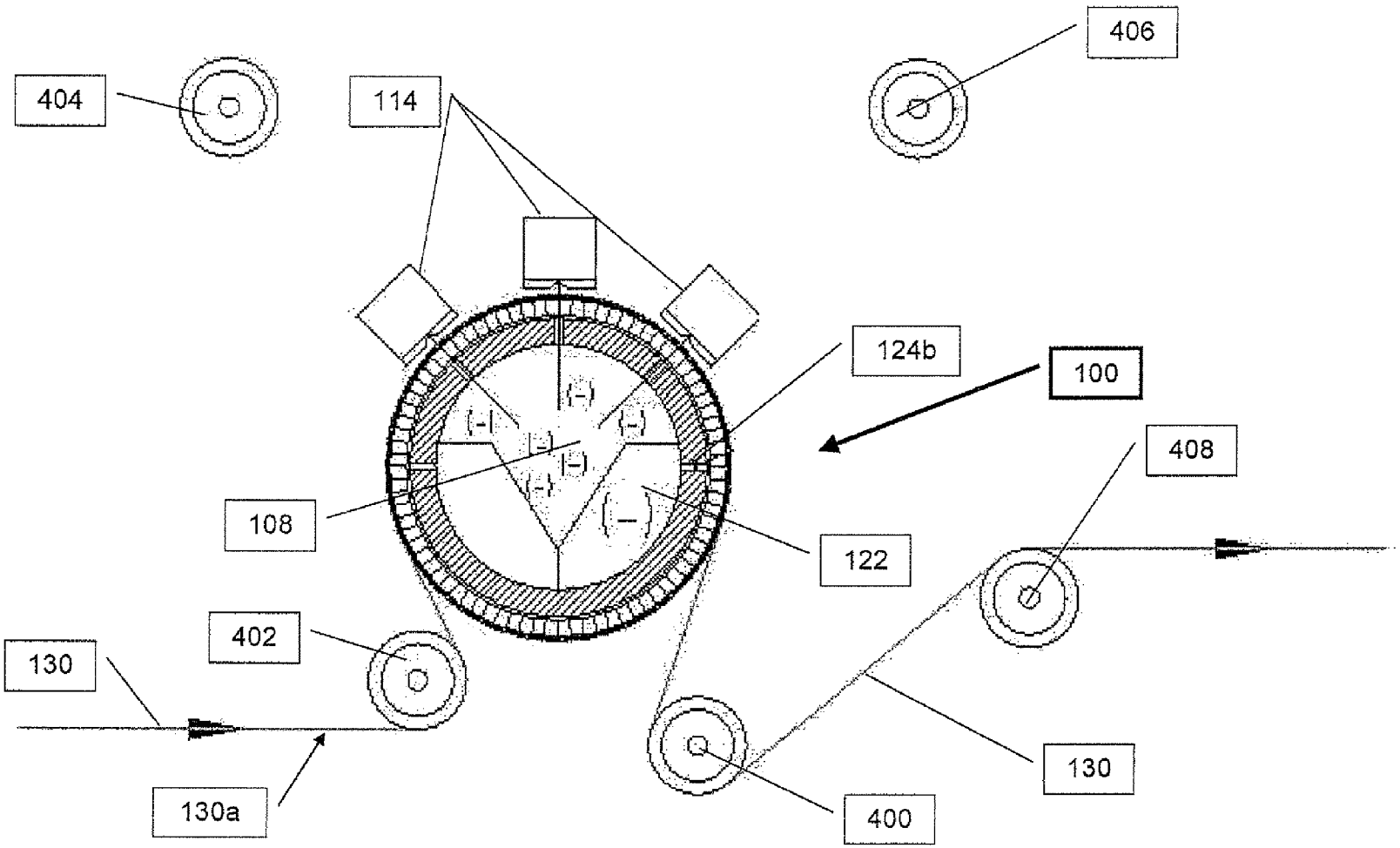
FIG. 7 is a schematic cross section of the patterning system of FIG. 6, shown here configured to apply the textured pattern to a second side of the fabric.

As illustrated in FIGS. 6 and 7, by configuring a high vacuum pressure suction chamber 120 and 122 circumferentially on either side of the low vacuum pressure suction chamber 108, the cylindrical suction box 100 assembly of the present invention may be use to apply a texture to either the top side or the bottom side of the fabric.

In the configuration of FIG. 6, the texture is being applied to the bottom side 130*b* of the fabric 130 by the fluid injectors 114 in conjunction with the low vacuum pressure suction chamber 108 and the de-watering process is performed by high vacuum pressure suction chamber 120 with the airflow passing through de-watering slot 124*a*. In this configuration, rollers 400, 402, 404, 406 and 408 are used to guide the fabric 130.

In the configuration of FIG. 7, the texture is being applied to the top side 130*a* of the fabric 130 by the fluid injectors 114 in conjunction with the low vacuum pressure suction chamber 108 and the de-watering process is performed by high vacuum pressure suction chamber 122 with the airflow passing through de-watering slot 124*b*. In this configuration, rollers 402, 400 and 408 are used to guide the fabric 130.

It will be appreciated, as illustrated in FIGS. 6 and 7, that the higher suction is preferably applied after the patterning process.

It will be appreciated that the above descriptions are intended only to serve as examples and that many other embodiments are possible within the spirit and the scope of the present invention.

What is claimed is:

1. A cylindrical suction box assembly for applying an embossed pattern to at least a portion of a continuous sheet of non-woven fabric produced by a water-entanglement process, the cylindrical suction box assembly comprising:

(a) a cylindrical suction box having a substantially cylindrical outer wall with a plurality of longitudinal slots configured in said outer wall, said suction box being substantially hollow with at least one interior dividing partition configured to divide an interior volume of said suction box into at least first and second suction chambers such that at least a first of said plurality of longitudinal slots opens into said first suction chamber and at least a second of said plurality of longitudinal slots opens into said second suction chamber;

(b) at least one fluid injector deployed proximal to an outer surface of said suction box and aligned with at least a first one of said plurality of longitudinal slots, said at least one fluid injector configured to deliver a flow of fluid to a surface of the substantially continuous sheet of non-woven fabric, said fluid then passing through said first of said plurality of longitudinal slots into said first suction chamber; and (c) an embossing roller having a patterned outer surface having a plurality of embossing-indentations, said embossing roller deployed about said suction box such that during rotation at least a portion of said embossing roller:

(i) passes between said fluid injector and said first of said plurality of longitudinal slots so as to force a portion of the non-woven fabric into at least some of said plurality of embossing-indentations; and (ii) subsequently passes over said second of said plurality of longitudinal slots such that a de-watering process is performed while said portion of the non-woven fabric remains in said plurality of embossing-indentations, and at least a portion of water being carried by the non-woven fabric is drawn into said second suction chamber.

2. The cylindrical suction box assembly of claim 1, further including a suction system having at least one suction device, said suction system configured to generate suction pressure within said first and said second suction chambers such that a suction pressure in said first suction chamber differs from a suction pressure generated in said second suction chamber.

3. The cylindrical suction box assembly of claim 1, wherein said fluid injector is configured as a plurality of fluid injectors, and each of said plurality of fluid injectors is aligned with a different one of said plurality of longitudinal slots each of which opens into said first suction chamber.

4. The cylindrical suction box assembly of claim 1, wherein said second suction chamber is configured as first and second de-watering chambers and said second of said plurality of longitudinal slots is configured as first and second de-watering slots such that said first de-watering chamber performs said de-watering process during said rotation in a first direction and said second de-watering chamber performs said de-watering process during said rotation in a second direction.

5. A cylindrical suction box assembly for applying an embossed pattern to at least a portion of a continuous sheet of non-woven fabric produced by a water-entanglement process, the cylindrical suction box assembly comprising:

(a) substantially cylindrical suction box having at least one lower suction pressure suction chamber and at least one higher suction pressure suction chamber, said suction box configured with at least one longitudinal texturing slot opening into said lower suction pressure suction chamber and at least one longitudinal de-watering slot opening into said higher suction pressure suction chamber;

(b) at least one fluid injector deployed proximal to an outer surface of said suction box and aligned with said texturing slot, said fluid injector configured to deliver a flow of fluid to a surface of the substantially continuous sheet of non-woven fabric, said fluid then passing through said texturing slot into said lower suction pressure suction chamber; and (c) an embossing roller having a patterned outer surface with a plurality of embossing-indentations, said embossing roller deployed about said suction box such that during rotation at least a portion of said embossing roller:

(i) passes between said fluid injector and said texturing slot such that a portion of the non-woven fabric is forced into at least some of said plurality of embossing-indentations; and (ii) subsequently passes over said de-watering slot such that a de-watering process is performed while said portion of the non-woven fabric remains in said plurality of embossing-indentations, and at least a portion of water being carried by the non-woven fabric is drawn into said second suction chamber.

6. The cylindrical suction box assembly of claim 5, further including a suction system having at least one suction device, said suction system configured to generate suction pressure within said lower and said higher suction chambers such that a suction pressure in said lower suction chamber is lower than a suction pressure generated in said higher suction chamber.

7. The cylindrical suction box assembly of claim 5, wherein said at least one fluid injector is configured as a plurality of fluid injectors and said at least one texturing slot is configured as a plurality of texturing slots, and each of said plurality of fluid injectors is aligned with a different one of said plurality of texturing slots each of which opens into said lower suction pressure suction chamber.

8. The cylindrical suction box assembly of claim 5, wherein said at least one higher suction pressure suction chamber is configured as first and second higher suction pressure suction chambers and said at least one de-watering slot is configured as first and second de-watering slots such that said first de-watering chamber performs said de-watering process during said rotation in a first direction and said second de-watering chamber performs said de-watering process during said rotation in a second direction.

9. A method for applying a texture to a surface of a substantially continuous sheet of fabric and performing a de-watering process on the patterned fabric using a single cylindrical suction box, the method comprising:

(a) providing a substantially cylindrical suction box having at least one lower suction pressure suction chamber and at least one higher suction pressure suction chamber, said suction box configured with at least one longitudinal texturing slot opening into said lower suction pressure suction chamber and at least one longitudinal de-watering slot opening into said higher suction pressure suction chamber;

(b) providing at least one fluid injector deployed proximal to an outer surface of said suction box and aligned with said texturing slot, said at least one fluid injector configured to deliver a flow of fluid to a surface of the substantially continuous sheet of non-woven fabric, said fluid then passing through said texturing slot into said lower suction pressure suction chamber;

(c) providing an embossing roller having a patterned outer surface having a plurality of embossing-indentations, said embossing roller deployed about said suction box;

(d) rotating said embossing roller such that at least a portion of said embossing roller passes between said fluid injector and said texturing slot such that a portion of the non-woven fabric is forced into at least some of said plurality of embossing-indentations; and (e) continuing rotation of said embossing roller such that said portion of said embossing roller subsequently passes over said de-watering slot such that a de-watering process is performed while said portion of the non-woven fabric remains in said plurality of embossing-indentations, and at least a portion of water being carried by the non-woven fabric is drawn into said second suction chamber.

10. The method of claim 9, further including providing a suction system having at least one suction device, said suction system configured to generate suction pressure within said lower and said higher suction chambers such that a suction pressure in said lower suction chamber is lower than a suction pressure generated in said higher suction chamber.

11. The method of claim 9, wherein said at least one fluid injector is implemented as a plurality of fluid injectors and said at least one texturing slot is implemented as a plurality of texturing slots, and each of said plurality of fluid injectors is aligned with a different one of said plurality of texturing slots each of which opens into said lower suction pressure suction chamber.

12. The method of claim 9, wherein said at least one higher suction pressure suction chamber is implemented as first and second higher suction pressure suction chambers and said at least one de-watering slot is implemented as first and second de-watering slots such that said first de-watering chamber performs said de-watering process during said rotation in a first direction and said second de-watering chamber performs the de-watering process during said rotation in a second direction.

* * * * *